US006196851B1

(12) United States Patent
Gerard et al.

(10) Patent No.: US 6,196,851 B1
(45) Date of Patent: Mar. 6, 2001

(54) REORIENTABLE ELECTRICAL OUTLET

(75) Inventors: Kimberly R. Gerard; Curtis Roys, both of Midland, TX (US)

(73) Assignee: Intelliglobe, Inc., Midland, TX (US)

( * ) Notice: Subject to any disclaimer, the term of this patent is extended or adjusted under 35 U.S.C. 154(b) by 0 days.

(21) Appl. No.: 09/458,163

(22) Filed: Dec. 9, 1999

(51) Int. Cl.[7] ..... H01R 39/00
(52) U.S. Cl. ..... 439/21; 439/20
(58) Field of Search ..... 439/21, 23, 24, 439/25, 26, 22, 20, 27, 28, 11, 13

(56) References Cited

U.S. PATENT DOCUMENTS

| | | | | |
|---|---|---|---|---|
| 2,134,355 | * | 10/1938 | Caldwell | 439/20 |
| 3,437,976 | * | 4/1969 | Nelson | 439/23 |
| 3,771,106 | * | 11/1973 | Matsumoto et al. | 439/23 |
| 4,583,798 | | 4/1986 | Blazowich | 339/8 |
| 5,352,122 | | 10/1994 | Speyer et al. | 439/13 |
| 5,399,093 | | 3/1995 | Schneider et al. | 439/21 |
| 5,425,645 | * | 6/1995 | Skovdal et al. | 439/23 |
| 5,595,503 | | 1/1997 | Pittman et al. | 439/446 |
| 5,772,447 | | 6/1998 | Cheung | 439/31 |
| 5,997,310 | * | 12/1999 | Chiu et al. | 439/21 |

* cited by examiner

*Primary Examiner*—Gary Paumen
*Assistant Examiner*—Ross Gushi
(74) *Attorney, Agent, or Firm*—J. Scott Denko; George & Donaldson, L.L.P.

(57) ABSTRACT

A reorientable electrical outlet employs rotatable female electrical receptacle(s) to allow rotation of a male plug while connected in the rotatable female electrical receptacle. The disclosed technique is adaptable to a variety of rotatable female electrical receptacles ranging from typical residential two receptacles, polarized/grounded receptacles, and non-grounded receptacles. The prongs of a male plug may be inserted into the rotatable female electrical receptacle and rotated to desired positions and remain substantially fixed. Male plug interference with other electrical receptacles is minimized.

21 Claims, 10 Drawing Sheets

REORIENTABLE ELECTRICAL OUTLET

TECHNICAL FIELD

The present invention relates to the field of electrical outlets, and in particular, to a reorientable electrical outlet.

BACKGROUND OF THE INVENTION

As the number of electrical appliances acquired by a household grows, the need for convenient access to numerous electrical outlets grows. Electrical outlets are, of course, well known in the art and typically comprise a face plate, multiple female sockets, and an outlet body.

In a typical residential electrical outlet, the female electrical sockets are fixed in orientation. The fixed orientation of the socket can reduce the flexibility of the electrical outlet. In some applications, the fixed socket orientation effectively reduces a two-socket outlet to a single-socket outlet.

A variety of techniques have been devised to increase the flexibility of power delivery sockets and plugs. For example, a species of low profile male plugs has been developed that orient the power cord off the axis of the male plug prongs. Rather than extending perpendicularly away from the wall in which the socket is mounted, such power cords extend off to a side or angle and consequently reduce power cord intention into living space or interference with furniture. Such low profile male plugs can reduce the flexibility of the outlet, however. For example, in polarized socket and plug arrangements, the required directional orientation dictates that the plug be inserted in only one direction. In some cases, particularly in four socket outlets, this can result in power cord interfere with access to other sockets in the same outlet.

There are prior techniques to ensure that the power cord does not overlay other outlet receptacles. Examples of such designs are illustrated in U.S. Pat. No. 4,927,376 to Dickie and U.S. Pat. No. 3,975,075 to Mason. Some of these problems may be resolved by a male plug design in which the cord rotates with respect to the prongs. An example of a rotatable male plug is purportedly shown in U.S. Pat. No. 4,026,618 to Straka. Many of these designs allow free movement between the male plug and power cord around a 360 degree path. The plugs are not, however, designed to be set or held at any particular angular position.

Socket interference can become particularly acute when a transformer for low voltage devices is integrated with a male power socket for direct insertion in a wall outlet. Such box-like transformers may directly block access to other sockets in the outlet face plate.

A conventional electrical outlet ordinarily allows only symmetrical positioning of the multiple female electrical receptacles. Thus, when an integrated male plug-transformer is plugged into one female electrical receptacle of an electrical outlet, an adjacent socket is typically blocked. To mitigate this interference, a multiplug adapter may be inserted into a female electrical receptacle to accommodate multiple male plugs in a given female electrical receptacle of the electrical outlet. This can present, however, an electrical hazard, in addition to an unsightly mess.

Electrical wiring codes may vary in different parts of a country or from country to country. Some electrical codes require female receptacles in the same electrical outlet box to be positioned horizontally with respect to one another, while other codes require female electrical receptacles in the same electrical outlet box to be positioned vertically with respect to one another. In some instances, electrical appliances can be readily accommodated by an electrical outlet of a certain orientation but may not be suitable for use with electrical outlets oriented at 90 degrees from the given orientation.

Consequently, there is a need for an angularly reorientable electrical socket to accommodate male plugs of a variety of configurations and combinations while remaining substantially fixed at a selected angular orientation.

SUMMARY OF THE INVENTION

A reorientable electrical outlet having a housing cavity in a stationary housing and a rotatable electrical female receptacle seated therein is disclosed. In one embodiment of the present invention, a pivot pin about which the female electrical receptacle can rotate in the housing cavity while maintaining electrical communication secures the rotatable electrical female receptacle in the housing cavity. The rotatable female electrical receptacle includes a set of electrically conductive sleeves situated in radial and electrical isolation from one another. The housing cavity has a set of annular nonconductive structures formed in concentric relation to one another to support a set of electrically conductive pathways on which the electrically conductive sleeves track. The rotatable female electrical receptacle further includes a set of apertures on a exterior top surface aligned with the electrically conductive sleeves for allowing a set of prongs of a male plug to extend through to acquire electrical contact with the electrically conductive pathways via the electrically conductive sleeves. The electrically conductive pathways, in turn, are connected to a set of wire conductors, thereby providing electrical communication between the male plug inserted in the rotatable electrical female receptacle and the wire conductors. In one embodiment, a locking mechanism is employed to releasably fix the position of the rotatable female electrical receptacle at a selected angular orientation. The male plug can be rotated to and fixed at a selected angular orientation with respect to the stationary housing of the electrical outlet body.

DETAILED DESCRIPTION OF PREFERRED EMBODIMENTS

Figure 1:
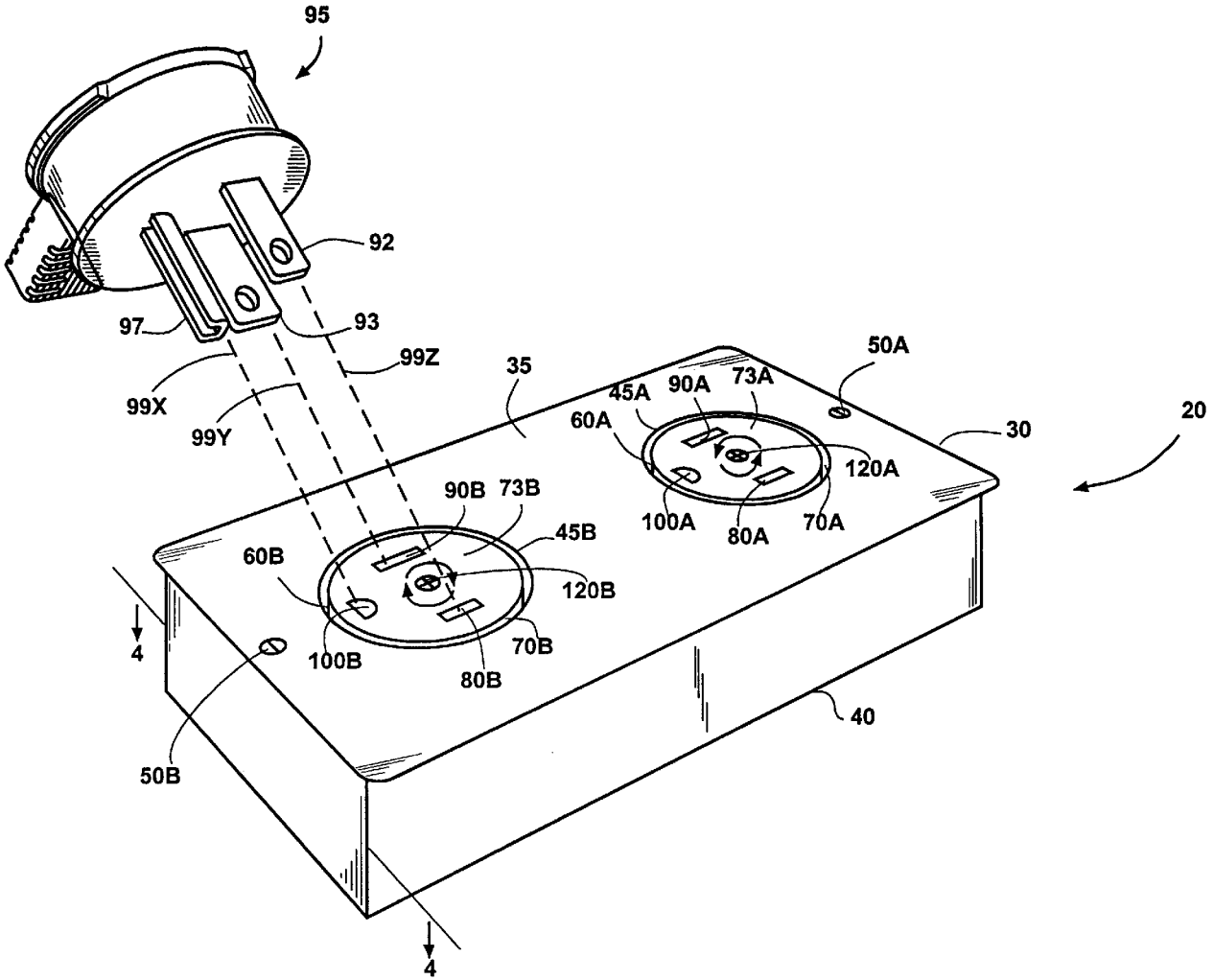
FIG. 1 is a perspective view of a preferred embodiment devised in accordance with the present invention.

In the following detailed description, spatially orienting terms are used such as "top," "bottom," "outward," "exterior," and the like. It is to be understood that these terms are used for convenience of description of the preferred embodiments by reference to the drawings. These terms do not necessarily describe the absolute location in space that any part must assume. The letters A and B associated with reference numerals indicate replica of the same element.

FIG. 1 shows a perspective view of a preferred embodiment of the present invention. Reorientable electrical outlet 20 is preferably formed of nonconductive material such as plastic or polyvinyl chloride (PVC) and is comprised of a plate 30 having a faceplate portion 35 and a receptacle housing 40 having two housing cavities 45A and 45B. Countersunk screw holes 50A and 50B receive screws for mounting reorientable electrical outlet 20 in a desired surface, such as an electrical box or wall.

Two grounded female electrical receptacles 60A and 60B are accommodated in respective receptacle housing cavities 45A and 45B through circular apertures 70A and 70B. Each of female electrical receptacles 60A and 60B exposed surfaces 73A and 73B, respectively.

Female electrical receptacles 60A and 60B further include apertures 80A, 90A and 80B, 90B, respectively, oriented for insertion of conventional power prong 92 and common prong 93 of depicted exemplary male plug 95. The depicted apertures 80A, 90A and 80B, 90B are generally of different size and shape as may be determined by a specific electrical code and/or standard. Each depicted female electrical receptacle 60A and 60B further includes respective ground apertures 100A and 100B. For example, in FIG. 1, ground aperture 100B receives ground prong 97 of male plug 95. The dotted lines 99X, 99Y, and 99Z indicate the respective relationships of the depicted prongs and the corresponding apertures.

In a preferred embodiment, female electrical receptacle 60A with common aperture 80A, power aperture 90A, and ground aperture 100A forms a female electrical receptacle subassembly. Female electrical receptacle 60A subassembly fits into circular aperture 70A. The diameter of the aperture 70A is slightly larger than the diameter of the female electrical receptacle 60A subassembly. The female electrical receptacle 60A subassembly is movably attached to receptacle housing 40 by an axial shaft 120A. Likewise, female electrical receptacle 60B is movably connected to receptacle housing 40 with axial shaft 120B. In operation, when male plug 95 is plugged into reorientable electrical outlet 20, it can be easily reoriented to a desired angular position by modifying the angular orientation of rotatable female electrical receptacle 60A, thereby allowing an easy deployment of different orientations of a variety of electrical male plugs having varying sizes and configurations.

Although, the depicted preferred embodiments of the invention employ two grounded female electrical receptacles, it should be understood that the invention is usable for a variety of female electrical receptacles including those that employ a single receptacle. It should also be recognized that the apertures 80, 90, and 100 in female electrical receptacle 60 can be replaced by any type of similar female socket that allows proper insertion and contact with a mating male-type conductive prongs of a male plug. Moreover, the invention is not limited to use with 110–220 V AC-type or DC-type appliances.

Figure 2:
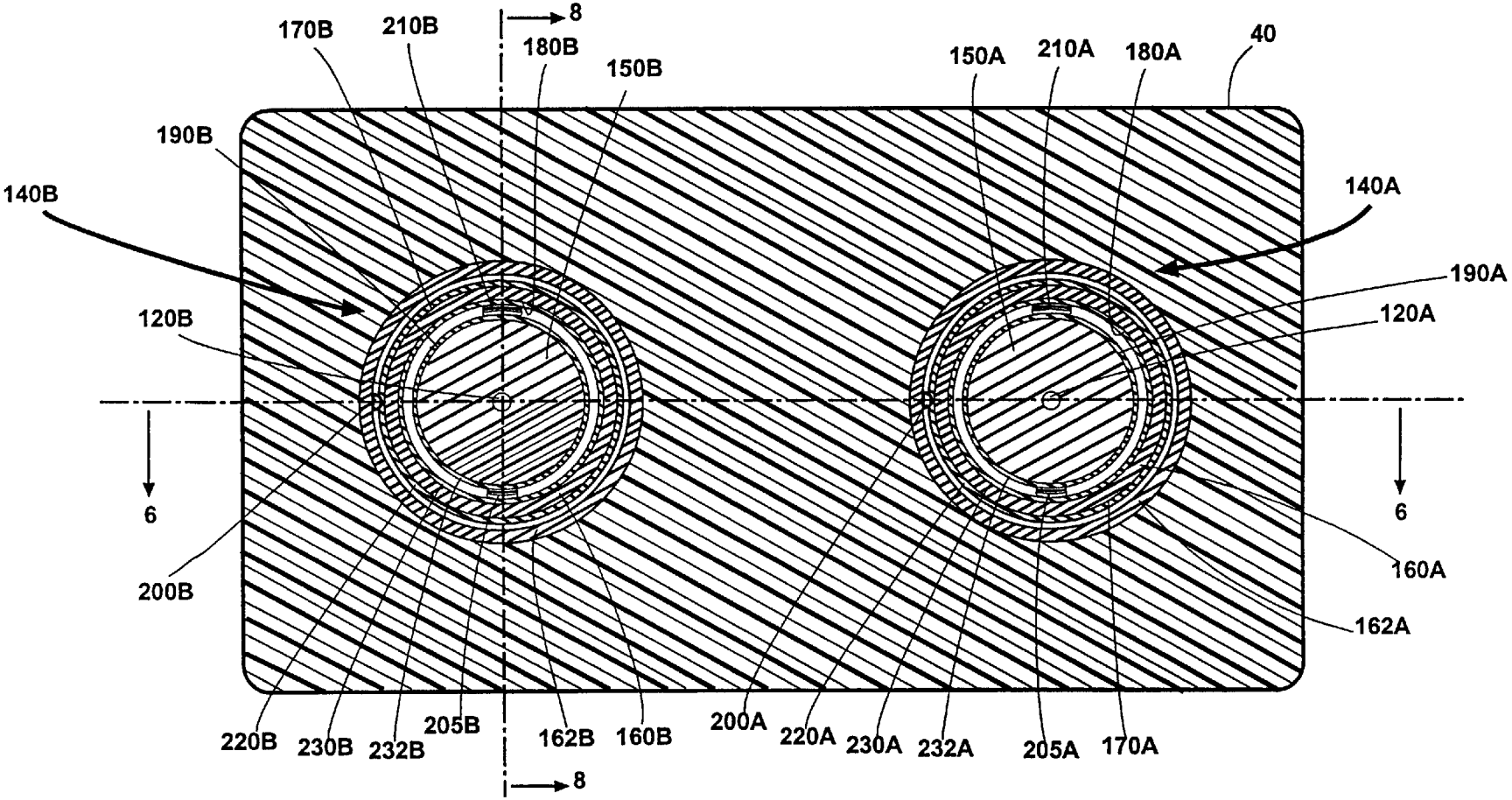
FIG. 2 is an enlarged cross-sectional top view of the reorientable electrical outlet of the present invention taken on the axis line 4—4 of FIG. 1.
Figure 3:
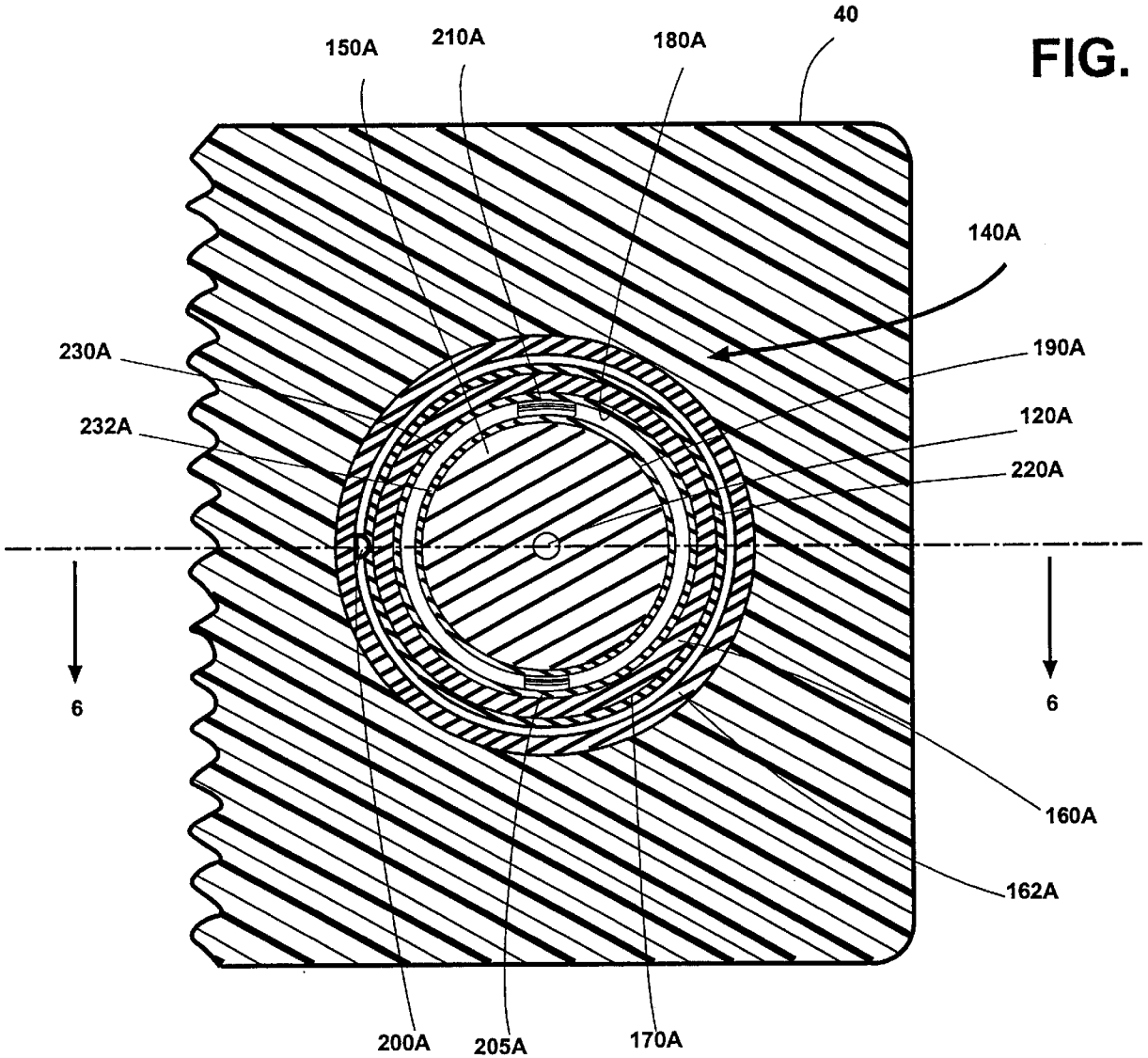
FIG. 3 is an enlarged view of a portion of FIG.2 depicting a reorientable electrical outlet devised in accordance with the present invention.

FIG. 2 depicts an enlarged cross-sectional view from the top of reorientable electrical outlet 20 taken on the axis line 4—4 of FIG. 1. With continuing reference to FIGS. 1 and 2, housing cavity 45A includes a set of concentric annular electrical conductor supporting structures 140A as shown in FIGS. 2 and 3. With continuing reference to FIGS. 2 and 3, a set of concentric annular conductor supporting structures 140A includes concentric annular components 150A, 160A, and 162A. For a three-prong male plug-receptive design, the set of concentric annular conductor supporting structures 140A includes an outer annular conductor bearing surface 170A that supports conductive circular ground pathway 220A, a middle annular conductor bearing surface 180A which supports conductive circular common pathway 230A, and an inner annular conductor bearing surface 190A that supports conductive circular power pathway 232A. Each of concentric aimular bearing surfaces 170A, 180A, and 190A is configured to be in electrical isolation from one another by inter-placed nonconductive concentric annular components 160A and 162A.

As shown in FIGS. 1 and 3, female electrical receptacle 60A subassembly includes ground conductive connector sleeve 200A to receive ground prong 97, power conductive connector sleeve 205A to receive power prong 92 and common conductive connector sleeve 210A to receive common prong 93, respectively. Ground conductive connector sleeve 200A angularly tracks on conductive ground pathway 220A. Power conductive connector sleeve 205A and common conductive connector sleeve 210A angularly track within common pathway 230A and power pathway 232A, respectively.

Figure 4A:
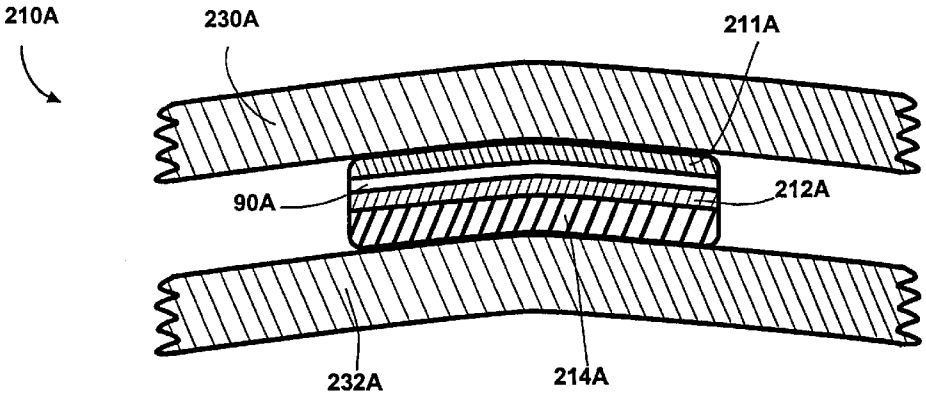
FIG. 4A is an enlarged view of a portion of FIG.3 depicting details of a conductive common sleeve in a preferred embodiment of the present invention.
Figure 4B:
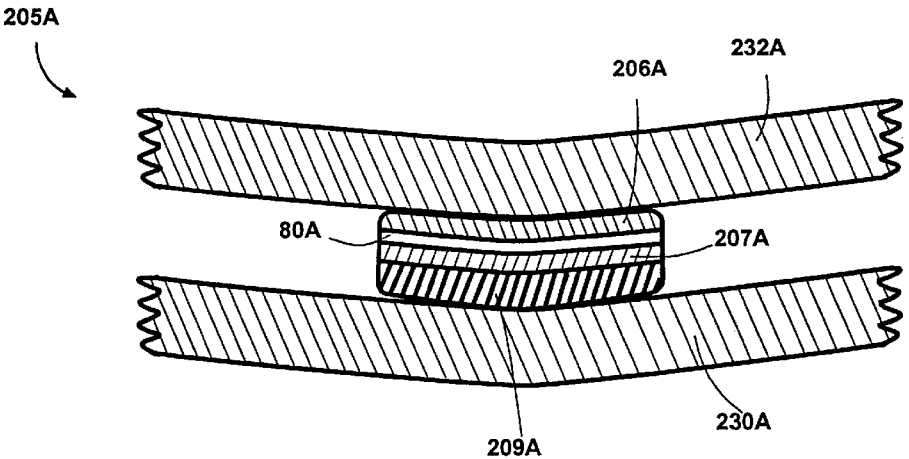
FIG. 4B is an enlarged view of a portion of FIG.3 depicting details of a conductive power sleeve in a preferred embodiment of the present invention.

FIGS. 4A and 4B are respective enlarged views depicting details of common conductive connector sleeve 210A and power conductive connector sleeve 205A of FIG. 3. Sleeves 205A and 210A are depicted in different sizes to correspond with electrical code-dictated polarization. Referring to FIG. 4A, common conductive connector sleeve 210A comprises conductive track connectors 211A and 212A disposed oppositely in electrical isolation. Nonconductive track component 214A prohibits electrical connectivity of common conductive connector sleeve 210A to conductive power pathway 232A. Conductive track connector 211A establishes electrical communication to conductive common pathway 230A.

In depicted FIG. 4B, power conductive connector sleeve 205A comprises conductive track connectors 206A and 207A disposed oppositely in electrical isolation. Nonconductive track component 209A prohibits electrical connectivity of power conductive connector sleeve 205A to conductive power pathway 230A. Conductive track connector 206A establishes electrical communication to conductive common pathway 232A.

In operation, rotatable female electrical receptacle 60A subassembly is configured to establish electrical communication between a conductive pathway and a power prong through a conductive connector sleeve. For example, power prong 92 inserted in power conductive connector sleeve 205A via aperture 80A is in electrical communication with power pathway 232A.

Figure 5:
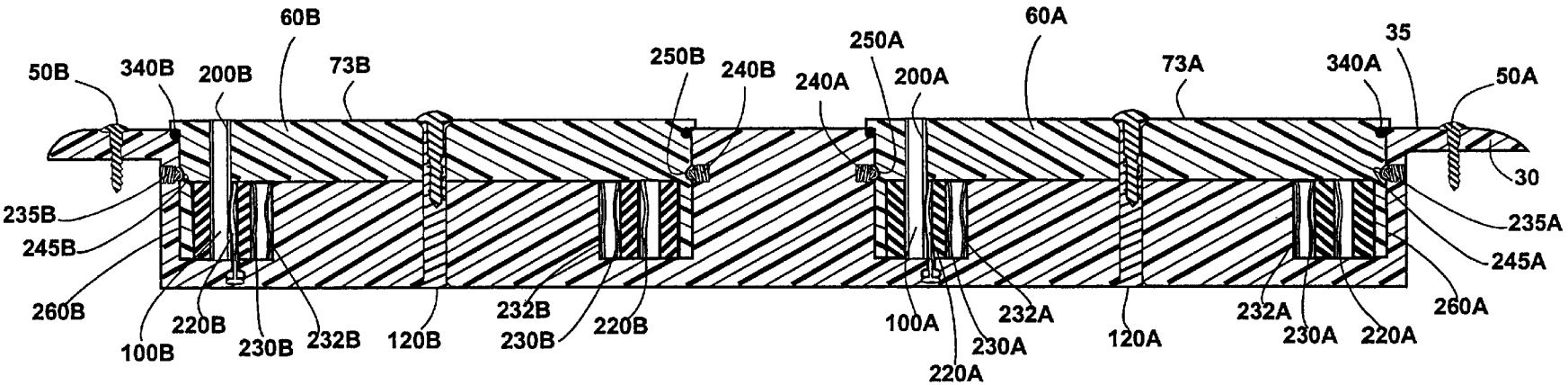
FIG. 5 is an enlarged longitudinal cross-sectional view of a preferred embodiment of the present invention taken on the axis line 6—6 of FIG. 2.

FIG. 5 illustrates an enlarged longitudinal cross-sectional view of a preferred embodiment of the present invention taken on the axis line 6—6 of FIG. 2. For clarity of the present exposition, an identical design to rotatable female electrical receptacles 60A and 60B and corresponding housing cavities 45A and 45B is assumed. The depicted embodiment of the present invention of FIG. 5 is illustrated with reference to female electrical receptacle 60B and associated housing cavity 45B. In order to sustain rotatable female electrical receptacle 60B subassembly at a desired orientation, an oppositely disposed pair of spring loaded balls 235B and 240B is employed. A plurality of radial apertures including apertures 245B and 250B are formed on the outward circumferential face 260B of rotatable female electrical receptacle 60B. Apertures 245B and 250B are axially spaced at regular intervals and are adapted to releasably engage reciprocal oppositely disposed pair of spring loaded balls 235B and 240B disposed in housing cavity 45B of integrated receptacle housing portion 40. Apertures 245B and 250B with reciprocal oppositely disposed pair of spring loaded balls 235B and 240B releasably lock the position of rotatable female electrical receptacle 60B with respect to plate 30. Consequently, a substantially locked position of male plug 95 with respect to plate 30 may be obtained at a selected angular orientation. In one embodiment, reorientable electrical outlet 20 can, therefore, allow male plug 95 to be oriented along a 360 degree rotation.

As will be understood, the particular locking structure may take on numerous other forms. As one example, the locking structure may include a plurality of ribs and reciprocal notches.

Female electrical receptacle 60B subassembly can be rotated, if necessary, to not interfere with the use of adjacent female electrical receptacle 60A of the reorientable electrical outlet 20. The oppositely disposed pair of spring loaded balls 235B and 240B ensures that once placed in a desired position, the female electrical receptacle 60B will not move significantly on its own accord. Axial shaft 120B acts as a pivot about which female electrical receptacle 60B may rotate. The position of female electrical receptacle 60B with respect to plate 30 can be releasably locked at a fixed desired angular orientation. It should be realized that the female electrical receptacle 60B subassembly of reorientable electrical outlet 20 need not be held together by axial shaft 120B. Pins, screws, fasteners, glue or snap-together parts are merely some of the structures that may be employed to perform the function of axial shaft 120.

Figure 6:
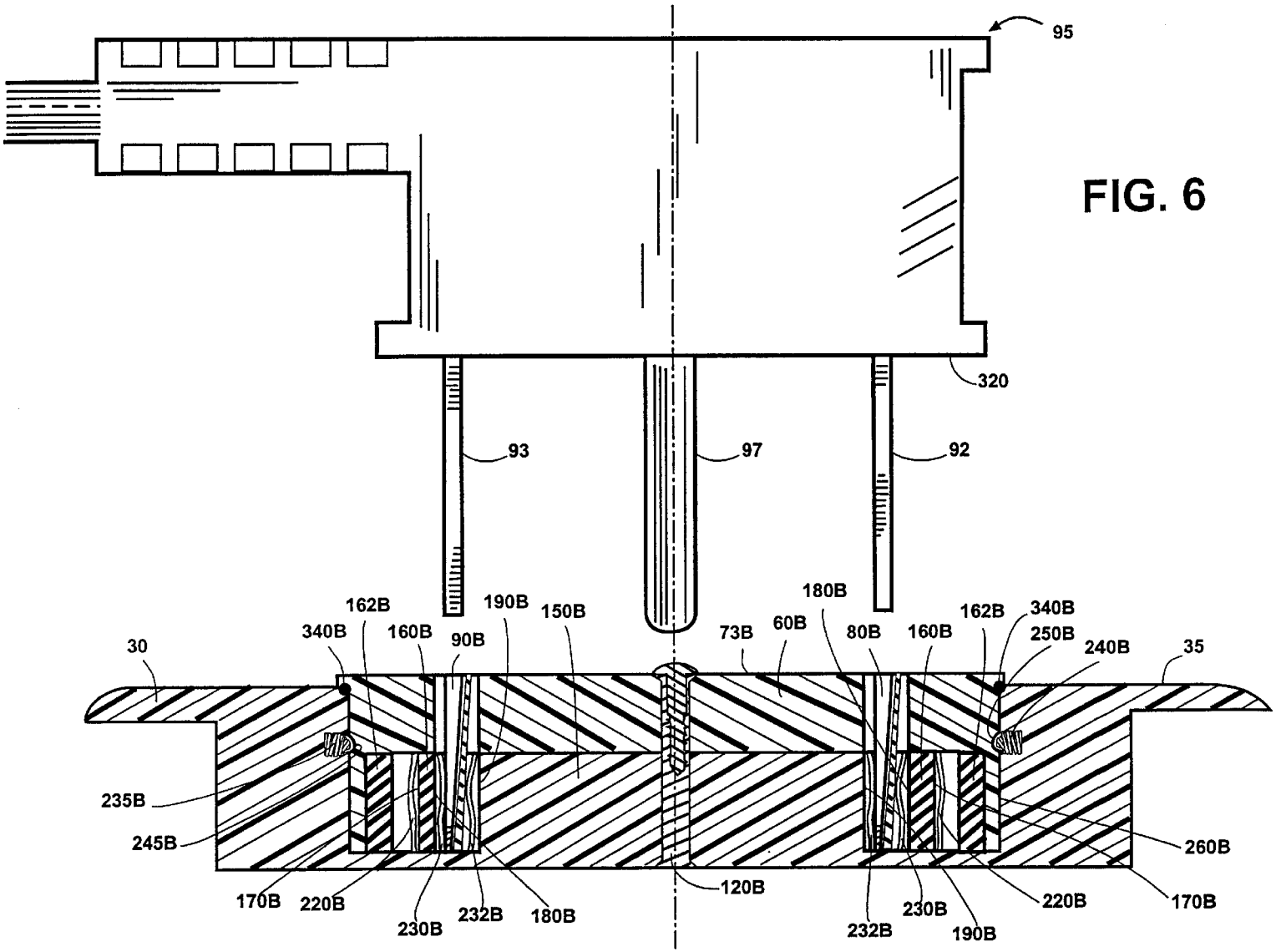
FIG. 6 is an enlarged transverse cross-sectional view of a preferred embodiment of the present invention taken on the axis line 8—8 of FIG. 2.

FIG. 6 shows an enlarged transverse cross-sectional view of a preferred embodiment of the present invention taken on the axis line 8—8 of FIG. 2. Electrically conductive prongs 92, 93, and 97 of male plug 95 extend in a perpendicular direction through exterior bottom surface 320 toward the exposed top surface 73B of female electrical receptacle 60B. Conductive prongs include a live or power prong 92, a common prong 93 and a ground prong 97. Prongs 92, 93, and 97 are oriented for insertion into power conductive connector sleeve 205B through power aperture 80B, common conductive connector sleeve 210B through common aperture 90B, and ground conductive connector sleeve 200B through ground aperture 100B, respectively.

With continuing reference to FIGS. 5 and 6, both rotatable female electrical receptacles 60A and 60B are fitted with properly aligned O-rings 340A and 340B, respectively. For example, O-ring 340B is aligned with conductive connector sleeves 200B, 205B and 210B properly positioned within housing cavity 45B conductive circular pathways 220B and 230B, while secured with axial shaft 120B. In a preferred embodiment of the present invention, lubricated rubber O-rings 340A and 340B are employed as a seal to prevent entry of undesirable material in housing cavities 45A and 45B.

Figure 7B:
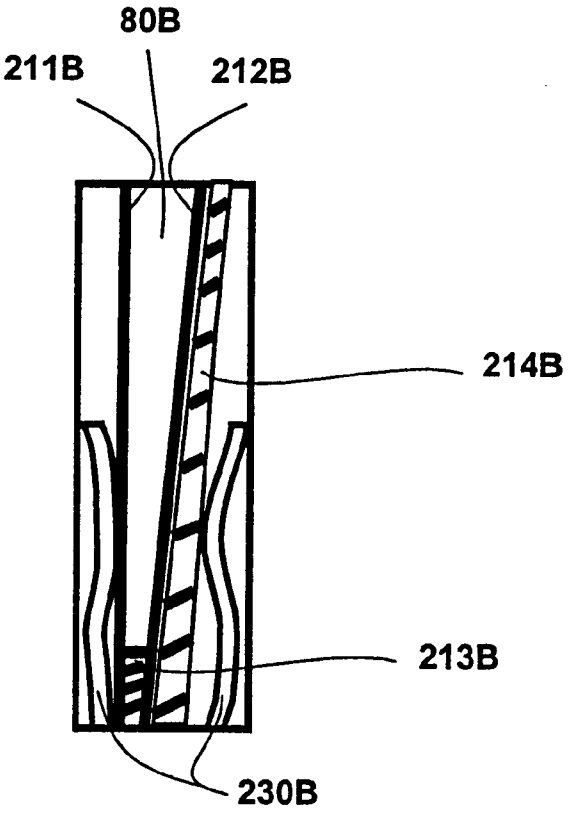
FIG. 7B is an enlarged view of a portion of FIG.6 depicting details of a conductive common connector sleeve contacting a power-common double-sided hollow conductive pathway in a preferred embodiment of the present invention.
Figure 7A:
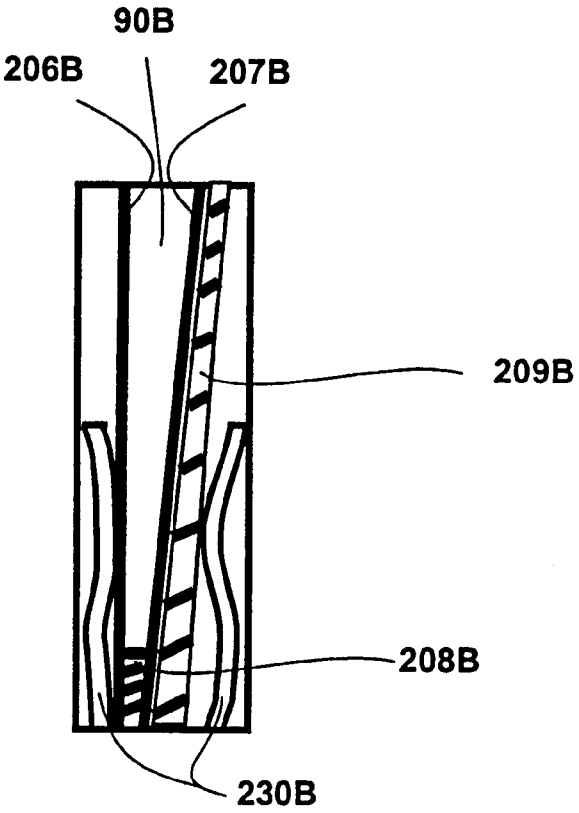
FIG. 7A is an enlarged view of a portion of FIG.6 depicting details of a conductive power connector sleeve contacting a power-common double-sided hollow conductive pathway in a preferred embodiment of the present invention.

FIG. 7A is an enlarged view of a portion of FIG. 6 depicting details of power conductive connector sleeve 205B. Nonconductive track component 208B is placed between conductive track connectors 206B and 207B to provide electrical isolation from one another. FIG. 7B is an enlarged view of a portion of FIG. 6 depicting details of common conductive connector sleeve 210B. Nonconductive track component 213B is inter-placed between conductive track connectors 211B and 212B to provide electrical isolation from one another.

Figure 8:
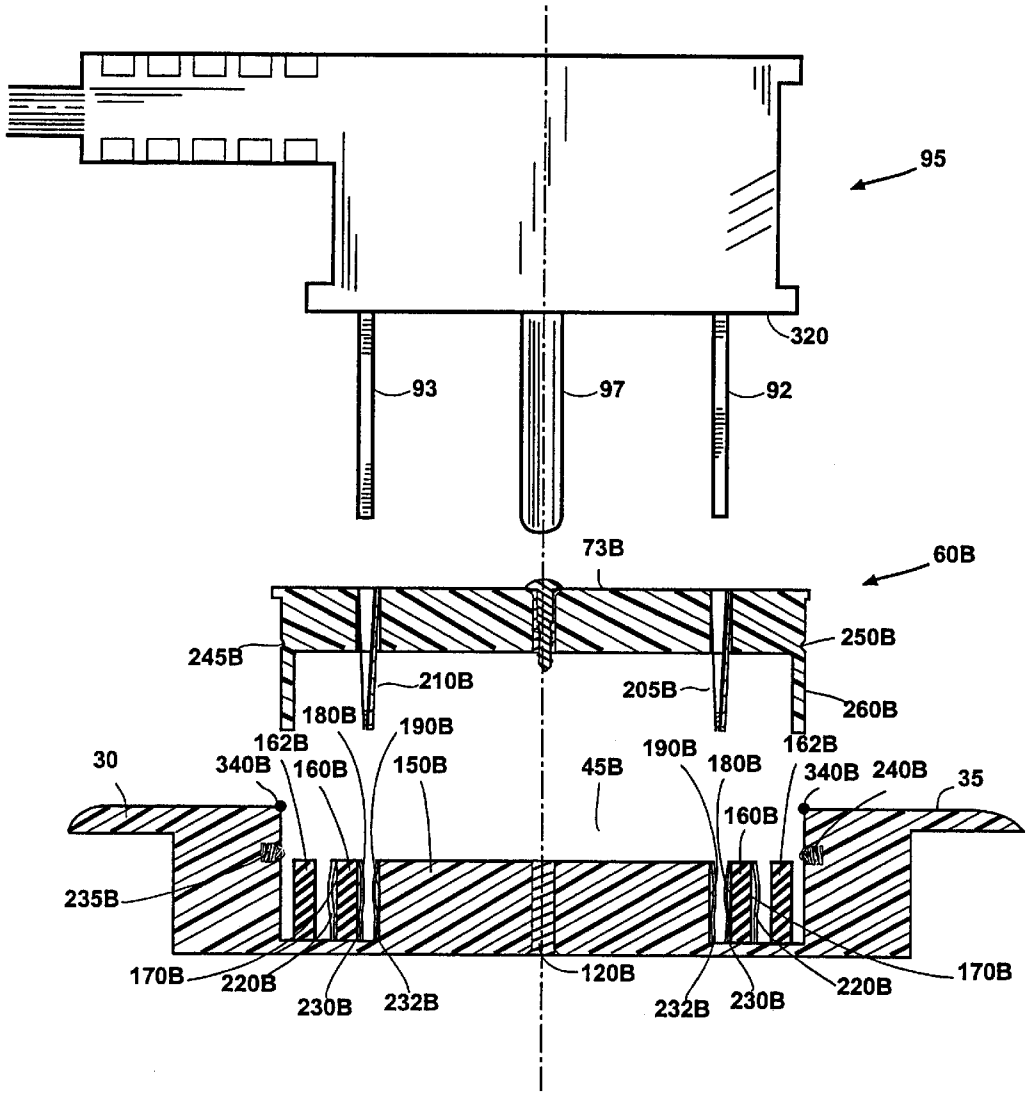
FIG. 8 illustrates separated elements of FIG. 6 including a male plug, a female electrical receptacle and a housing cavity of a stationary housing of a preferred embodiment devised in accordance with the present invention.

FIG. 8 illustrates separated elements of FIG. 6 including male plug 95, female electrical receptacle 60B and housing cavity 45B. Female electrical receptacle 60B sits in housing cavity 45B and is secured with axial shaft 120B about which female electrical receptacle 60B rotates in housing cavity 45B while in electrical communication with housing cavity 45B.

Figure 9A:
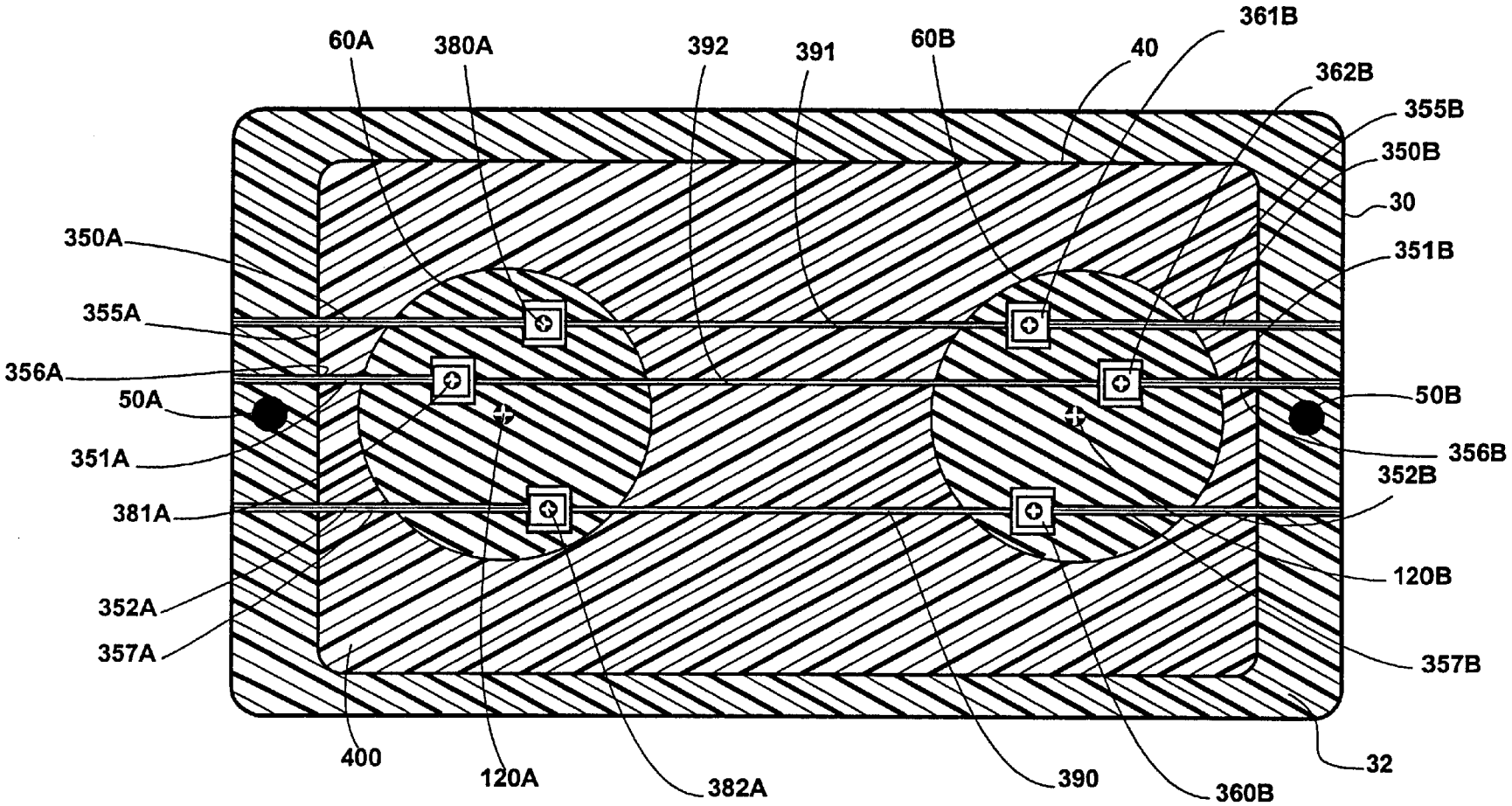
FIG. 9A is a bottom view of the preferred embodiment of the present invention depicted in FIG. 1.
Figure 9B:
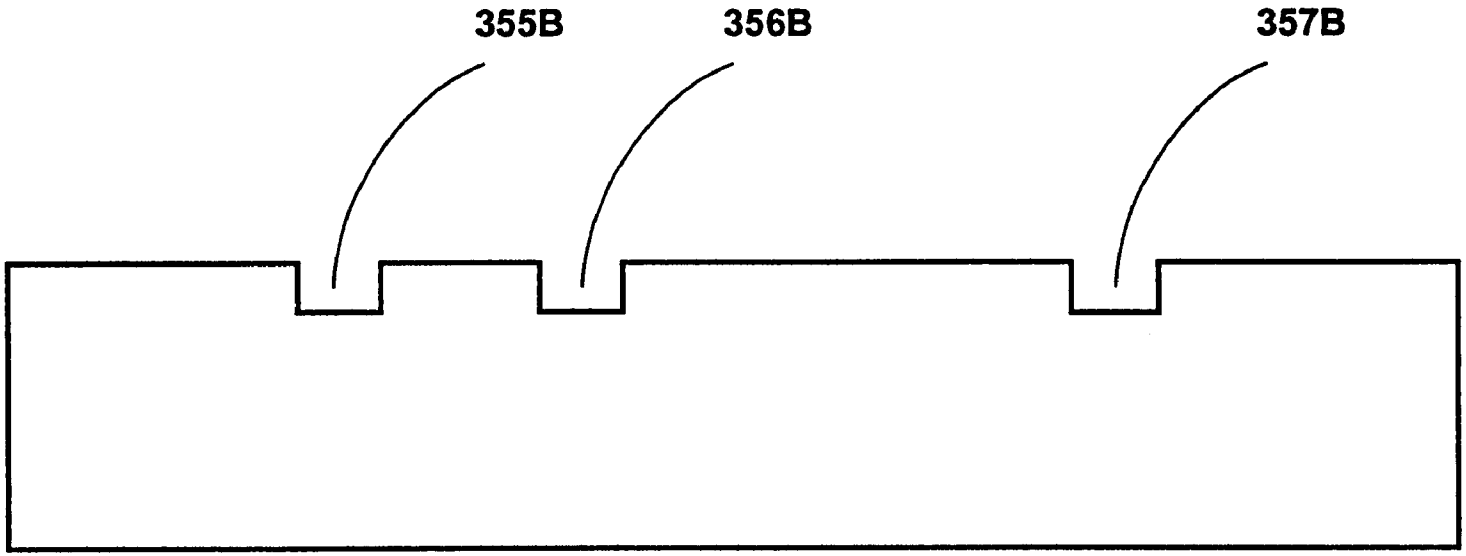
FIG. 9B is an elevation view of the preferred embodiment depicted in FIG. 9A.

FIG. 9A depicts a bottom view of the preferred embodiment of FIG. 1 of the present invention. Raised border 32 elevates outlet 20 above its mounting surface. With continuing reference to FIGS. 8 and 9A, common wire conductor 350B, ground wire conductor 351B, and power wire conductor 352B are connected to respective conductive common pathway 230B, conductive ground pathway 220B, and conductive power pathway 232B. As shown in FIG. 9A and 9B, reorientable electrical outlet 20 incorporates molded indentions on the back of female electrical receptacles 60A and 60B. Molded indentions in border 32, i.e., wire guides 355B, 356B, and 357B, are provided as pathways for common wire conductor 350B, ground wire conductor 351B, and power wire conductor 352B to lay within.

Wire guides 355B, 356B, and 357B and conductor set screws 380B, 381B, and 382B with associated holding clamps 360B, 361B, and 362B with serrated edges are provided to all the connections of wire conductors 350B, 351B, and 352B. Conductor set screws 380B, 381B, and 382B utilize a compression design for ease of connection and subsequent insertion into an associated receptacle box. Conductive connector bands 390B, 391B, and 392B are employed to conductively connect the respective conductive power, common and ground pathways 232B, 230B, and 220B of the female electrical receptacle 60B. A preferred rotatable outlet 20 has integrated isolation rim 400 to allow wire conductors 350B, 351B, and 352B and conductor set screws 380B, 381B, 382B to be recessed from any contact points within the receptacle box. Conductive prongs 92, 93, and 97 oriented for insertion into reorientable electrical outlet 20 can be positioned such that a portion of each prong 92, 93, and 97 including the distal end can be seated in the corresponding prong receiving conductive connector sleeves 200B, 205B and 210B to acquire electrical contact with a respective one of conductive pathways 220B 230B, and 232B.

In operation, when male plug 95 prongs 92, 93, and 97 are inserted in respective conductive connector sleeves 200B, 205B and 210B of female electrical receptacle 60B, they acquire electrical contact to corresponding conductive connector sleeves 200B, 205B and 210B. Since conductive connector sleeves 200B, 205B and 210B track on associated conductive pathways 220B 230B, and 232B connected to wire conductors 350B, 351B, and 352B, male plug 95 prongs 92, 93, and 97 acquire electrical connection to respective wire conductors 350B, 351B, and 352B. For example, ground prong 97 seated in ground conductive connector sleeve 200B contacts annular conductive ground pathway 220B which is electrically connected to ground wire conductor 351B. In this manner, an electrical connection for 360 degrees can be provided between each prongs 92, 93, and 97 and a respective one of the wire conductors 350B, 351B, and 352B. As female electrical receptacle 60B is rotated relative to plate 30, prongs 92, 93, and 97 seated in conductive connector sleeves 200B, 205B and 210B move along associated annular conductive pathways 220B and 230B while substantially maintaining electrical connection.

The various conductive components employed in the depicted embodiment of the present invention are preferably of brass. However, as persons skilled in the art will recognize, any suitable conductive material can be employed for this purpose. For example, use of brass, copper, steel alloys, and other alloys is prevalent. The employed nonconductive components of the depicted embodiment of the present invention can be of any suitable nonconductive or insulative material including plastic and polyvinyl chloride (PVC). Again, those skilled in the art will appreciate that any suitable nonconductive or insulative material may be employed. For clarity of the present exposition, a simple exemplary reorientable electrical outlet 20 is illustrated, although those skilled in the art will appreciate, reorientable electrical outlet 20 described here is adaptable to a variety of models, configurations and may be devised to include many other types of female electrical receptacles and adapters. For example, the present invention may be embodied in an adapter devised to convert a fixed socket to a reorientable facility.

It should also be understood that, the number, form, and structure of female electrical receptacles are merely examples and not to be construed as design limitations required for employment in the present invention. For example, female electrical receptacles 60A and 60B could range from typical residential receptacles, both grounded and non-grounded, all the way up through power strip, 220V receptacles, and up through 480V receptacles including 2, 3, 4, or more prong-receptive designs. These devices can allow for prongs of a variety of male plugs to be inserted into the female electrical receptacles and rotated to any desired positions, so as to allow for non-interfering positioning with regards to other male plugs or other types of restrictions which could preclude the use of any given male plug into an adjacent female electrical receptacle.

In an alternate embodiment of the present invention, female electrical receptacles may be devised to include only oppositely disposed apertures oriented for insertion of conventional power and common prongs of an exemplary non-polarized male plug. Such a two-prong male plug-receptive design of the female electrical receptacles requires no outer concentric annular conductor supporting structure component for the absent ground prong, which is present in the case of the three-prong male plug-receptive preferred embodiment.

The embodiments described above are merely illustrative and skilled persons can make variations on them without departing from the scope of the invention. Although the present invention and its advantages have been described in detail, it should be understood that various changes, substitutions and alterations can be made to the embodiments described herein without departing from the spirit and scope of the invention as defined by the appended claims.

What is claimed is:

1. A reorientable electrical outlet comprising:

a stationary housing;

first and second female electrical receptacles, each receptacle having first and second electrically conductive sleeves electrically isolated from each other;

first and second annular conductive paths;

first and second housing cavities disposed in the stationary housing to receive the first and second female electrical receptacles, the first and second housing cavities each having annular conductive path surfaces against which are disposed the first and second annular conductive paths, respectively; and first and second axial shafts about which the first and second female electrical receptacles angularly move in the first and second housing cavities respectively while maintaining electrical communication between the first electrically conductive sleeve and the first annular conductive path and between the second electrically conductive sleeve and the second annular conductive path.

2. The reorientable electrical outlet of claim 1, wherein the stationary housing further comprises:

a set of molded pathways for a set of wire conductors to lay within to accommodate a series connection between the first and second female electrical receptacles.

3. The reorientable electrical outlet of claim 1, wherein the first and second female electrical receptacles further comprise:

an exposed surface;

first and second apertures through the exposed surface aligned with the first and second electrically conductive sleeves to allow first and second prongs of a male plug to extend through the first and second apertures respectively, to acquire electrical contact with the first and second electrically conductive sleeves.

4. The reorientable electrical outlet of claim 1, wherein a set of molded indentations is formed as recessed wire guides for a set of wire conductors.

5. The reorientable electrical outlet of claim 4, further comprising a set of conductor screws and holding clamps with serrated edges employed to create a set of connections to the set of wire conductors on the back of each female electrical receptacle.

6. The reorientable electrical outlet of claim 5, further comprising conductive connector bands to conductively connect the set of connections of each female electrical receptacle.

7. The reorientable electrical outlet of claim 1 further comprising:

a third electrically conductive sleeve electrically isolated from the first and second electrically conductive sleeves; and a third conductive path in electrical communication with the third electrically conductive sleeve.

8. The reorientable electrical outlet of claim 7, wherein an O-ring seals each female electrical receptacle with its associated housing cavity.

9. The reorientable electrical outlet of claim 7, wherein the first, second, and third electrically conductive sleeves are of brass.

10. The reorientable electrical outlet of claim 7, wherein the first, second, and third electrically conductive pathways are of brass.

11. The reorientable electrical outlet of claim 7 wherein the first and second female electrical receptacles further comprise:

an exposed surface;

first, second and third apertures through the exposed surface aligned with the first, second and third electrically conductive sleeves to allow first, second, and third prongs of a male plug to extend through the first, second, and third apertures respectively, to acquire electrical contact with the first, second, and third electrically conductive sleeves.

12. The reorientable electrical outlet of claim 11, wherein the first, second, and third prongs of the male plug are power, common, and ground, respectively.

13. The reorientable electrical outlet of claim 11, wherein the male plug can be rotated 360 degrees.

14. The reorientable electrical outlet of claim 7, wherein a plurality of radial apertures are formed on a circumferential facing of the first and second female electrical receptacles.

15. The reorientable electrical outlet of claim 14, further comprising an oppositely disposed pair of spring-loaded balls disposed in each housing cavity of the stationary housing employed to substantially hold each female electrical receptacle at a selected angular orientation.

16. The reorientable electrical outlet of claim 14, wherein the radial apertures located on the circumferential facing of each female electrical receptacle are axially spaced and adapted to releasably engage reciprocal oppositely-disposed spring loaded balls disposed in each housing cavity.

17. The reorientable electrical outlet of claim 7, further comprising an integrated face plate.

18. The reorientable electrical outlet of claim 17, wherein the set of conductor screws utilizes a compression design for the ease of connection and subsequent insertion into an associated receptacle box.

19. The reorientable electrical outlet of claim 17, wherein the stationary housing has an integrated isolation rim to recess the set of wire conductors and the set of conductor screws.

20. A reorientable electrical outlet comprising:

a stationary housing;

an electrical receptacle having first and second electrically conductive sleeves electrically isolated from each other;

first and second annular conductive paths;

a housing cavity disposed in the stationary housing to receive the female electrical receptacle, the housing cavity having annular conductive path bearing surfaces upon which are disposed the first and second annular conductive paths, respectively; and an axial shaft about which the female electrical receptacle angularly moves in the housing cavity while maintaining electrical communication between the first electrically conductive sleeve and the first annular conductive path and between the second electrically conductive sleeve and the second annular conductive path.

21. The reorientable electrical outlet of claim 20 further comprising:

a third electrically conductive sleeve electrically isolated from the first and second electrically conductive sleeves; and a third conductive path in electrical communication with the third electrically conductive sleeve.

* * * * *